United States Patent [19]

Kamath

[11] 4,389,188

[45] Jun. 21, 1983

[54] GAS BURNER INJECTOR HEAD

[75] Inventor: Bola R. Kamath, Ridge, N.Y.

[73] Assignee: ABC Sunray Corporation, Commack, N.Y.

[21] Appl. No.: 205,906

[22] Filed: Nov. 12, 1980

[51] Int. Cl.[3] ..... F23Q 9/00

[52] U.S. Cl. ..... 431/284; 239/424.5; 431/182; 431/187

[58] Field of Search ..... 431/284, 285, 187, 188, 431/182; 239/406, 424.5

[56] References Cited

U.S. PATENT DOCUMENTS

| | | | |
|---|---|---|---|
| 2,973,032 | 2/1961 | Reilly et al. | 431/188 X |
| 3,163,203 | 12/1964 | Ihlenfield | 431/284 X |
| 3,217,779 | 11/1965 | Reed et al. | 431/285 |
| 3,342,242 | 9/1967 | Verloop | 431/187 X |
| 4,303,386 | 12/1981 | Voorheis et al. | 431/284 X |

*Primary Examiner*—Edward G. Favors
*Attorney, Agent, or Firm*—McAulay, Fields, Fisher, Goldstein & Nissen

[57] ABSTRACT

A burner head with a central tubular chamber through which air flows has an annular chamber around the tubular chamber. Gas flows forward through the annular chamber. The end wall of the annular chamber is an annulus having five openings therethrough. Five tubular nozzles extend forward and radially inward from these five openings to direct the flow of gas toward the ignition electrode and the combustion zone within the tubular chamber. Three of the nozzles are relatively close to one another along a short arc at the upper portion of the annulus. Two of the nozzles are positioned about 120° from one another along the lower portion of the arc of the annulus.

9 Claims, 6 Drawing Figures

GAS BURNER INJECTOR HEAD

BACKGROUND OF THE INVENTION

This invention relates in general to a gas burner injector head and more particularly to one that is adapted to be incorporated as part of the dual injector head including a liquid fuel injector as well as the gas fuel injector.

Gas fuel and liquid fuel burner injector heads have been employed for a very long period of time. More recently, combined designs have been provided which permit the user to alternately select gas fuel or liquid fuel so that the user can take advantage of changes in the relative differences of prices of the fuels involved. These combination injector heads employ a different nozzle structure for liquid fuel and for gas fuel but associate the two nozzle structures in the same head casing so that the user can essentially switch from the use of one fuel to the other fuel. One combination injector head design which is known to applicant employs an annular chamber for bringing the gas to a series of openings in an end wall annulus. Gas flows through the series of openings into the combustion chamber.

When the gas fuel is employed, it is important that the gas burn in a radially uniform fashion in order to provide the most efficient heating effect. It is also important that the ignition of the gas be assured. Providing the gas fuel in a fashion that results in uniform burning will enhance the assurance that it will ignite. Accordingly, it is a purpose of this invention to provide a gas fuel injector head design which will provide uniform burning of the gas fuel and assure ignition of the gas fuel.

A preferred embodiment of this invention includes a liquid fuel injection nozzle which provides a predetermined burning pattern for the liquid fuel. The oil burner nozzle arrangement and its burning pattern are known and predetermined. In order to assure that the heating efficiency of the gas is optimum, it is important that the burning pattern of the gaseous fuel be substantially the same as the burning pattern of the liquid fuel. Thus it is a further object of this invention to provide a gas fuel burning pattern that, in addition to being uniform, conforms to the oil fuel burning pattern.

BRIEF DESCRIPTION

In brief, in one embodiment of this invention a standard liquid fuel (oil) burner nozzle arrangement is provided along the central axis of an injector head. Around this oil burner nozzle, there is deployed a set of five nozzles for injecting gas into the burning zone. The exit port of each of these five gas nozzles is radially outboard from the oil burner nozzle and axially back from the opening of the oil burner nozzle. The exit ports of the five nozzles are in the same axial position.

It has been found that a particular circumferential deployment of these five gas nozzles will provide desired uniform burning with assured ignition and a fair approximation to the configuration of burning of the oil. Specifically, three of the nozzles are deployed symmetrically around the circumference of a circle; that is, at an angle of 120° from each other. One of these nozzles, which is termed herein the upper nozzle, is positioned radially above the central axis of the burner head when the head is held in its usual operating position. The fourth and fifth nozzle are deployed so that their exit ports are spaced on either side of the upper nozzle. The fourth nozzle, in one embodiment is 15° circumferentially spaced on one side of the upper nozzle and the fifth nozzle is 15° circumferentially spaced on the other side of the upper nozzle. The nozzle ports face inward as well as forward to direct the gas to the combustion zone.

Having these nozzle ports so deployed and directed provides the desired uniform burning, assured ignition and burning pattern conformance with the oil burning pattern.

DESCRIPTION OF THE PREFERRED EMBODIMENTS

Figure 1:
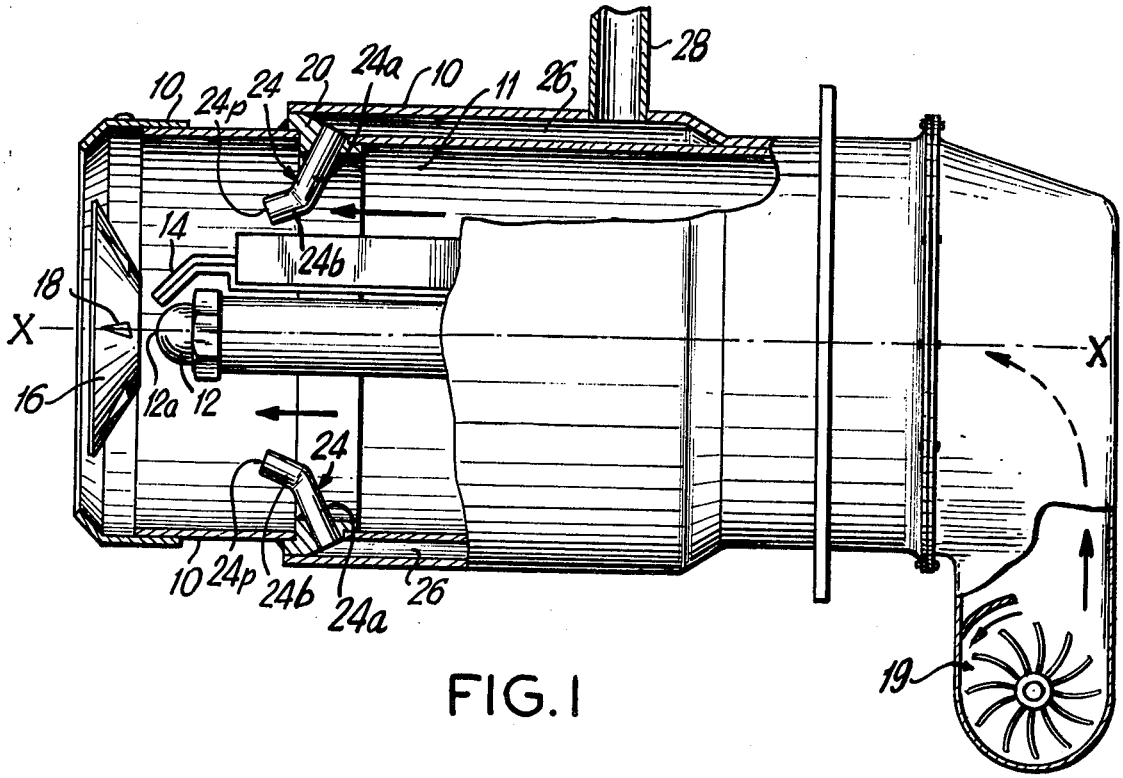
FIG. 1 is an elevational view in partial cutaway and cross-section illustrating an embodiment of this invention.
Figure 2:
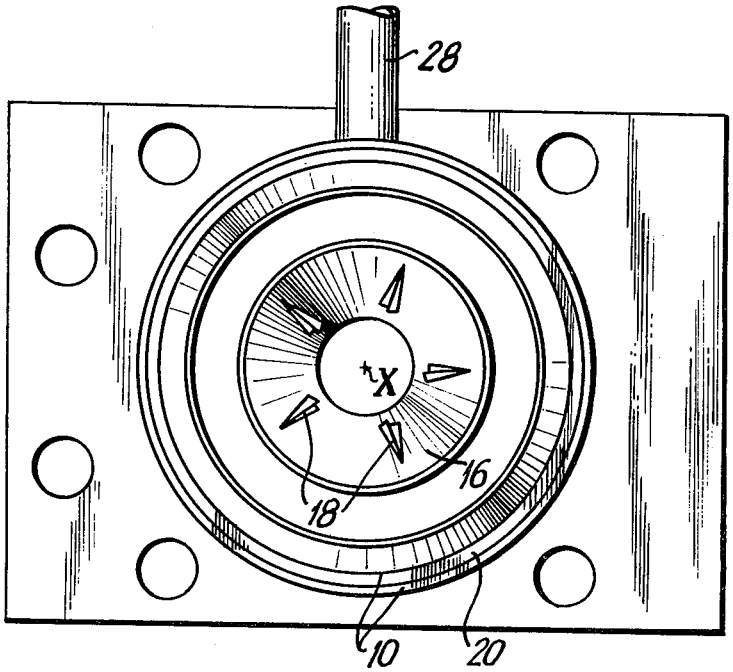
FIG. 2 is a front elevational view of the FIG. 1 device.

FIGS. 1 through 5 illustrate a single embodiment which has been built and tested.

The burner head shown has an essentially annular casing 10 around a tubular central zone 11 in which is housed the oil nozzle 12 having an orifice **12*a* to atomize the oil. Ignition electrodes 14 and a frusto-conical air distributor 16 having five vanes 18 are positioned within this tubular zone 11. A standard blower 19 provides an axial air stream in the forward direction, as indicated by the arrows, through the tubular section 11. This arrangement relating to the oil nozzle 12 and air distributor 16** is of a known and fairly standard type. One example of such is illustrated and described in U.S. Pat. No. 3,211,207 issued on Oct. 12, 1965 to A. N. Luft. Accordingly, the operation of this feature of the embodiment illustrated herein will not be described in any greater detail than is necessary to disclose its relationship to the total combination which constitutes this invention.

Figure 3:
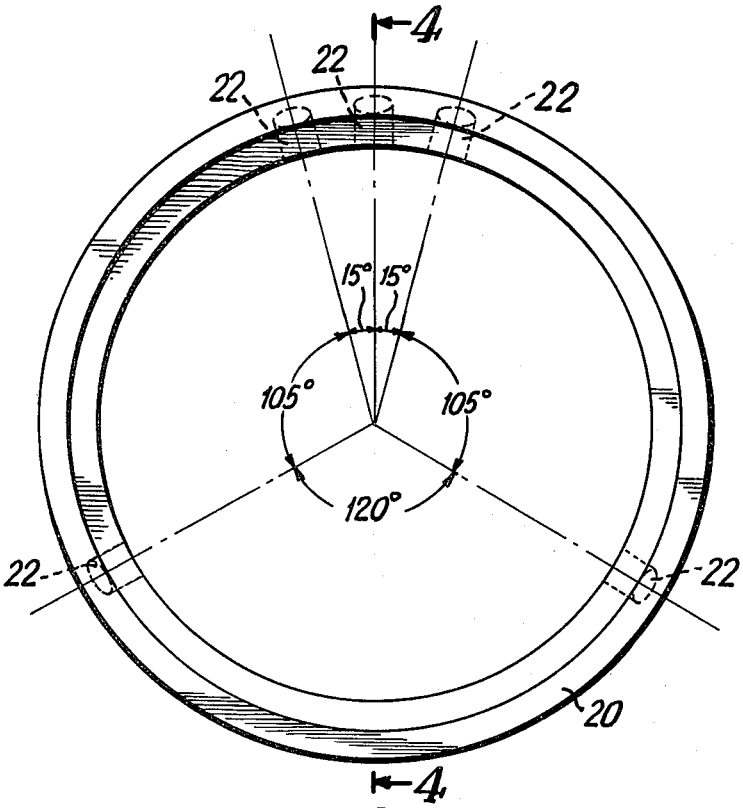
FIG. 3 is an elevational view of an annulus that is employed as one of the elements of the FIG. 1 device and which supports the nozzles through which gas is injected into the burning chamber of the FIG. 1 device.
Figure 4:
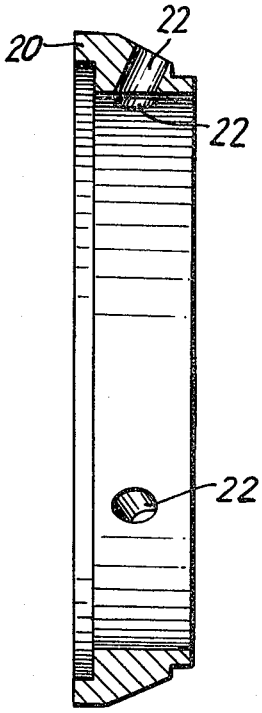
FIG. 4 is a cross-sectional view of the FIG. 3 annulus taken along the plane 4—4 in FIG. 3.
Figure 5:
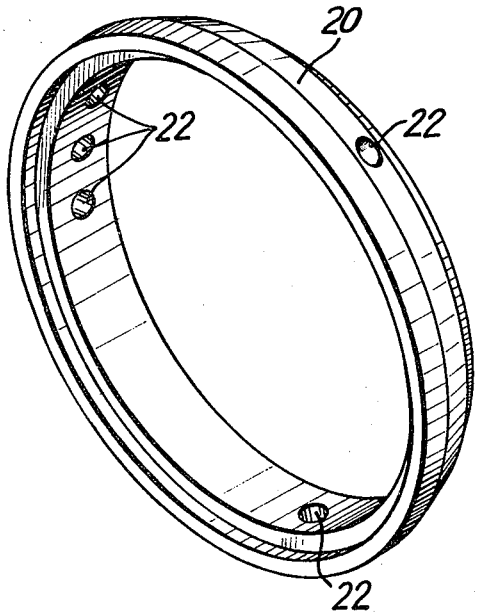
FIG. 5 is a perspective view of the FIG. 3 annulus.
Figure 6:
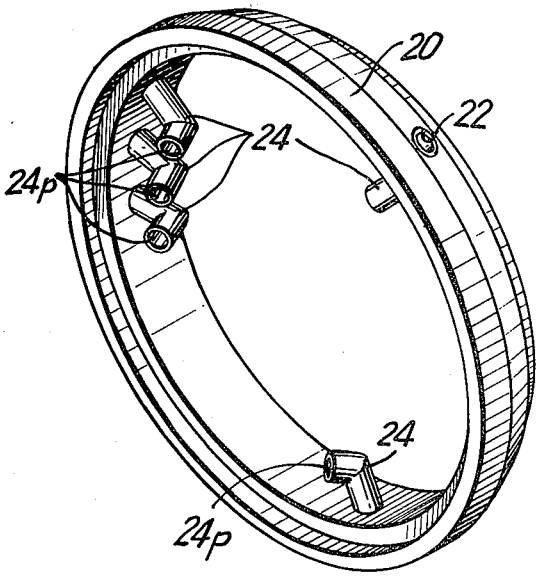
FIG. 6 is a perspective view of the FIG. 3 annulus with the five nozzles assembled thereon.

The annulus 20, illustrated in FIGS. 3, 4 and 5, is positioned around the oil nozzle 12 and rearward of the exit port from the oil nozzle 12. There are five openings 22 which extend through the annulus 20. These openings 22 each support a nozzle 24. Each nozzle 24 extends radially inward and axially forward from a respective opening 22 to provide five exit ports **24*p* circumferentially arranged around the axis X—X of the burner head. The exit port 24*p* of each nozzle 24 is an equal radial distance from the axis X—X. Each nozzle 24 is cylindrical and through the respective annulus opening 22 is in communication with an annular chamber 26. The annular chamber 26, in turn, is connected through the inlet pipe 28 to a source of fuel gas under pressure so that when an appropriate switch (not shown) is turned on, gas under pressure is admitted through the annular chamber 26 to the rear end of each of the five nozzles 24 to the combustion zone at the front of this burner head. The gas is ignited by the ignitor electrodes 14. These ignitor electrodes 14 are also used to ignite the liquid fuel emitted from the oil nozzle 12 when this burner is used in a liquid fuel mode. A mode switch (not shown) is employed to determine whether a liquid fuel, such as fuel oil, is provided at the oil injector 12 or a gaseous fuel, such as natural gas, is provided by the gas nozzle 24**.

What applicant has found is that the circumferential deployment of the five nozzles 24, corresponding to the circumferential arrangement of the annulus opening 22 as shown in FIGS. 3 and 5, is required to assure ignition and uniform burning of gas in a burner unit adapted to be employed in a typical home. In large furnaces requiring a large volume of gaseous fuel, burner heads have been employed that incorporate an annular ring having a large number of openings, without nozzles, to admit a large volume of gas through to the combustion area. Ignition is assured and the burning pattern is stable because of the large volume of gas involved. Problems arose in attempting to scale down the larger volume burner head arrangements for use with a furnace or boiler size employed in the typical home. The missing ignition problem arose out of the scaling down of the design and in particular because of the reduction in the number of annulus openings to reduce the amount of gas to that called for in a home installation. This missing ignition problem was solved by use of the small tubular nozzles 24. Because of the small volume of gas involved, a non-uniform burning pattern tends to occur which is undesirable in terms of providing the maximum heat transfer to the boiler. Employing three nozzles 24 close to one another along the top of the head and two nozzles equally spaced on the lower half of the head provides a gas flow that results in a fairly uniform burning pattern consistant with assured ignition.

The application of a gas burner head to a relatively small boiler involves certain space limitations, particularly where a dual head design such as the embodiment shown is desired. The burner, in such a case, is close to the boiler and this imposes geometric limitations on the deployment of the oil nozzle and gas nozzles relative to one another. These geometric limitations are also part of the reason why it is desired to have approximately the same burning pattern for both the gas and the oil so as to provide efficient and effective heating of the boiler.

Each nozzle 24 has a first section **24*a* and a second section 24*b*. The axis of the more outboard section 24*a* is at an angle of approximately 40° to a vertical plane. The downstream section 24*b* has an axis that substantially intercepts the central axis X—X of the casing 10 at an angle of about 20°. Thus dual portion configuration is required because of the dimensional limitations of the injector head and particularly because of the dimensional requirements for proper functioning of the oil injector 12. The first portion 24*a* serves to bring the gas that is to be injected inboard to a position well within the air stream. The downstream portion 24*b* serves to eject the gas in a direction and at an angle such that it will properly ignite and burn. In an embodiment which has been constructed, the center of the ports 24*p* lie in the circumference of a circle having a 6.6 centimeter diameter. The distance from the ports 24*p* to the back surface of the air distributor element 16 is 2.6 centimeter. The dimensional relationships between the oil injector 12 and air distributor 16** are predetermined and known in this art.

The angling of the nozzle portion **24*b*** is important to cause the gas to flow together at the combustion area to assure ignition and the proper burning configuration.

The above invention is taught as being particularly applicable to use with burner units that process a relatively smaller volume of gaseous fuel, such as a typical burner unit employed in a home. One unit that has been designed is for a capacity of 100,000 BTU per hour. It is believed that the nozzle arrangement and design illustrated may be used for burner heads having any capacity under 200,000 BTU per hour.

What is claimed is:

1. A gas burner injector head comprising:

a housing having an annular chamber positioned around a tubular chamber, said annular chamber having a back end adapted to communicate with a source of gas, said annular chamber having a front end with a plurality of openings therethrough, said tubular chamber having a back end adapted to communicate with a source of air, a set of nozzles, one each extending from respective ones of said openings of said annular chamber, each of said nozzles having a forward port, the forward port of each of said nozzles being positioned within whatever stream is caused to flow along said tubular chamber, a first subset of said nozzle ports being deployed approximately equal distance from one another around a substantially circular locus, and a second subset of said nozzle ports deployed along an arc of said locus that constitutes a relatively small fraction of the circumference of said circular locus.

2. The gas burner of claim 1 wherein: at least one member of said first subset is a member of said second subset.

3. The gas burner of claim 1 wherein: said first subset includes first, second and third ports deployed approximately equal distances from one another and said second subset includes said first port and fourth and fifth ports, said first, fourth and fifth ports spanning an arc that constitutes a relatively small fraction of the circumference of said circular locus.

4. The gas burner of claim 3 wherein: said fourth and fifth ports are deployed respectively on first and second sides of said first port.

5. The gas burner injector head of claim 4 wherein said fourth and fifth nozzle ports are each deployed approximately 15° from said first nozzle port.

6. The gas burner injector head of claims 1, 2, 3, 4 or 5 further comprising:

an oil fuel injector positioned along the axis of said tubular chamber, the injection port from said oil fuel injector being positioned downstream from said forward ports of said nozzles.

7. The gas burner injector head of claims 1, 2, 4 or 5 wherein said nozzle forward ports all lie substantially on a plane perpendicular to the axis of said tubular chamber.

8. The gas burner injector head of claim 7 wherein the axes of said nozzle forward ports substantially lie on the surface of a cone having an interior angle of approximately 40°.

9. The gas burner of claims 7 or 8 further comprising:

a frusto-conical air distributor having vanes positioned downstream from said exit port of said oil fuel injector.

* * * * *